US010721568B2

(12) United States Patent
Dogiamis et al.

(10) Patent No.: US 10,721,568 B2
(45) Date of Patent: Jul. 21, 2020

(54) PIEZOELECTRIC PACKAGE-INTEGRATED ACOUSTIC TRANSDUCER DEVICES

(71) Applicant: Intel Corporation, Santa Clara, CA (US)

(72) Inventors: Georgios C. Dogiamis, Chandler, AZ (US); Feras Eid, Chandler, AZ (US); Adel A. Elsherbini, Chandler, AZ (US); Johanna Swan, Scottsdale, AZ (US); Shawna M. Liff, Scottsdale, AZ (US); Thomas L. Sounart, Chandler, AZ (US); Sasha N. Oster, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/096,568

(22) PCT Filed: Jul. 1, 2016

(86) PCT No.: PCT/US2016/040843
§ 371 (c)(1),
(2) Date: Oct. 25, 2018

(87) PCT Pub. No.: WO2018/004688
PCT Pub. Date: Jan. 4, 2018

(65) Prior Publication Data
US 2019/0141456 A1 May 9, 2019

(51) Int. Cl.
*H04R 17/00* (2006.01)
*B06B 1/06* (2006.01)

(52) U.S. Cl.
CPC ..... *H04R 17/005* (2013.01); *B06B 1/0622* (2013.01); *B06B 1/0625* (2013.01); *B06B 1/0644* (2013.01); *H04R 2201/028* (2013.01)

(58) Field of Classification Search
CPC ..... H04R 17/005; H04R 2201/028; B06B 1/0622; B06B 1/0644
See application file for complete search history.

(56) References Cited

U.S. PATENT DOCUMENTS

2010/0148627 A1* 6/2010 Funasaka ..... G01H 11/08 310/316.01
2012/0098625 A1 4/2012 Martin et al.
(Continued)

OTHER PUBLICATIONS

International Preliminary Report on Patentability for International Patent Application No. PCT/US2016/040843, dated Jan. 10, 2019, 11 pages.
(Continued)

*Primary Examiner* — Sunita Joshi
(74) *Attorney, Agent, or Firm* — Schwabe, Williamson & Wyatt, P.C.

(57) ABSTRACT

Embodiments of the invention include an acoustic transducer device having a base structure that is positioned in proximity to a cavity of an organic substrate, a piezoelectric material in contact with a first electrode of the base structure, and a second electrode in contact with the piezoelectric material. In one example, for a transmit mode, a voltage signal is applied between the first and second electrodes and this causes a stress in the piezoelectric material which causes a stack that is formed with the first electrode, the piezoelectric material, and the second electrode to vibrate and hence the base structure to vibrate and generate acoustic waves.

22 Claims, 11 Drawing Sheets

(56) References Cited

U.S. PATENT DOCUMENTS

| | | | | |
|---|---|---|---|---|
| 2013/0205899 | A1 | 8/2013 | Wu et al. | |
| 2015/0145374 | A1 | 5/2015 | Xu et al. | |
| 2015/0165479 | A1* | 6/2015 | Lasiter | B06B 1/0666 310/322 |
| 2016/0107194 | A1* | 4/2016 | Panchawagh | G06F 3/0436 367/140 |

OTHER PUBLICATIONS

International Search Report and Written Opinion for International Patent Application No. PCT/US2016/040843 dated Mar. 17, 2017, 14 pgs.

* cited by examiner

PIEZOELECTRIC PACKAGE-INTEGRATED ACOUSTIC TRANSDUCER DEVICES

CROSS-REFERENCE TO RELATED APPLICATION

This patent application is a U.S. National Phase Application under 35 U.S.C. § 371 of International Application No. PCT/US2016/040843, filed Jul. 1, 2016, entitled "PIEZOELECTRIC PACKAGE-INTEGRATED ACOUSTIC TRANSDUCER DEVICES," which designates the United States of America, the entire disclosure of which is hereby incorporated by reference in its entirety and for all purposes.

FIELD OF THE INVENTION

Embodiments of the present invention relate generally to package integrated acoustic transducer devices. In particular, embodiments of the present invention relate to piezoelectric package integrated acoustic transducer devices.

BACKGROUND OF THE INVENTION

Acoustic transducers convert acoustic waves into electrical signals and vice versa. Some common examples include ultrasonic transducers for ultrasound waves which typically have frequencies greater than the human audible limit of approximately 19-20 kHz. Other examples include sonic transducers such as microphones and speakers for audible signals. Those devices that both transmit and receive may also be called acoustic transceivers; many acoustic transducers besides being sensors are indeed transceivers because they can both sense and transmit. These devices work on a principle similar to that of transducers used in radar which evaluate attributes of a target by interpreting the echoes from radio waves. Active acoustic sensors generate acoustic waves and evaluate the echo which is received back by the sensor. These sensors measure the time interval between sending the signal and receiving the echo to determine the distance to an object. Passive acoustic sensors are basically microphones that detect acoustic signals that are present under certain conditions, convert it to an electrical signal, and report it to a computer.

An array of acoustic transducers yields a phased array (PA) acoustic system, where each of the transducers can be operated independently. By varying the pulse timing between the transducers (similar to a radio frequency (RF) antenna phased array), the system can focus the acoustic wave using constructive interference patterns. The system can scan a larger area without having to move or adjust the position of the sensors. Several applications use this technique such as flaw detection in materials (non-destructive testing), medical imaging, ultrasonic sonar for 3D space mapping, haptic feedback using ultrasound waves, microphones and microphone arrays.

However, these systems are typically bulky since acoustic transducers have a relatively large z-height (>>5 mm). Moreover, the assembly of discrete transducers to create a larger phased array increases the cost for a system with a large area (e.g., 10 cm×10 cm) and also may lead to a decrease of the system spatial resolution. MEMS technology used for the creation of acoustic (e.g., sonic or ultrasonic) transducers produces much lower z-height than the above systems. However, manufacturing processes for silicon-based MEMS technology are expensive due to expensive materials and wafer-scale fabrication and can be very challenging or possibly not even feasible over large areas.

DETAILED DESCRIPTION OF THE INVENTION

Figure 1:
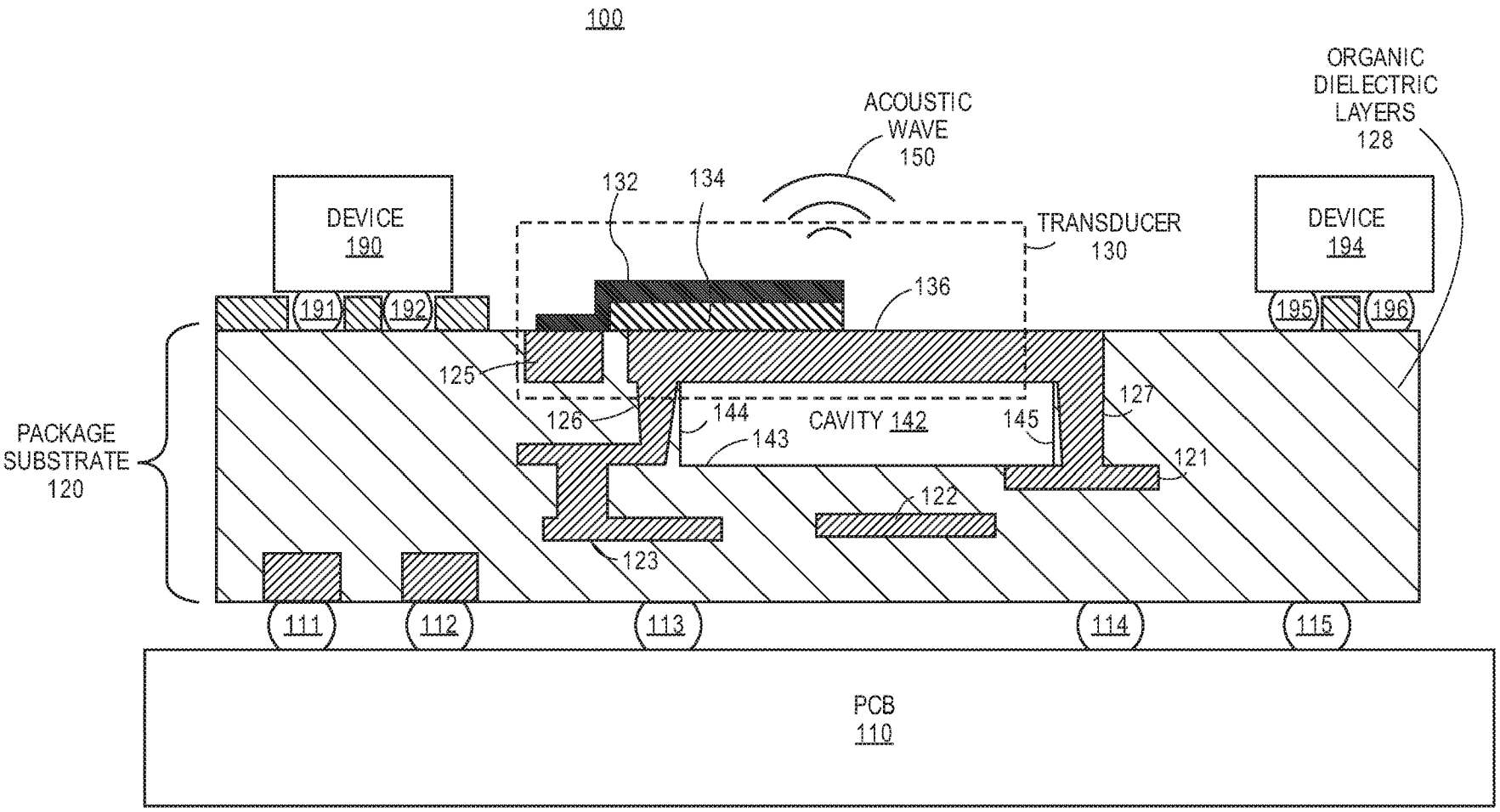
FIG. 1 illustrates a view of a microelectronic device 100 having a package-integrated piezoelectric transducer device, according to an embodiment.

Described herein are piezoelectric package integrated acoustic transducer devices. In the following description, various aspects of the illustrative implementations will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order to not obscure the illustrative implementations.

Various operations will be described as multiple discrete operations, in turn, in a manner that is most helpful in understanding the present invention. However, the order of description should not be construed to imply that these operations are necessarily order dependent. In particular, these operations need not be performed in the order of presentation.

The present design provides thin, low cost acoustic transducers that are manufactured as part of an organic package substrate traditionally used to route signals between the CPU or other die and the board. The acoustic transducers allow the fabrication of piezoelectric acoustic (e.g., sonic, ultrasonic, infrasonic, 10kHz-10MHz frequency range, etc.) transducers utilizing substrate manufacturing technology. These transducers include suspended base structures (e.g., membranes) that are free to move and are mechanically coupled to a piezoelectric material. The base structures can be actuated to vibrate and produce acoustic waves by applying a voltage to the piezoelectric material. Conversely, acoustic waves received by the base structure can cause vibration and deformation of the piezoelectric material which generates an electric signal that can be used to sense the received wave. The system therefore acts as an acoustic transceiver.

The present design results in package-integrated piezoelectric acoustic transducers, thus enabling thinner systems, tighter integration and more compact form factor in comparison to systems with discrete assembled transducers. For the present design, the transducers are directly created as part of the substrate itself with no need for assembling external components.

The present design can be manufactured as part of the substrate fabrication process with no need for purchasing and assembling discrete components. It therefore enables high volume manufacturability (and thus lower costs) of systems that need sonic or ultrasonic wave sensing/generation (such as microphones, sonars, medical imaging systems, non-destructive testing, texture transmission for haptic feedback systems etc.). Package substrate technology using organic panel-level (e.g., ~0.5 m×0.5 m sized panels) high volume manufacturing (HVM) processes has significant cost advantages compared to silicon-based MEMS processes since it allows the batch fabrication of more devices using less expensive materials. However, the deposition of high quality piezoelectric thin films has been traditionally limited to inorganic substrates such as silicon and other ceramics due to their ability to withstand the high temperatures required for crystallizing those films. The present design is enabled by a new process to allow the deposition and crystallization of high quality piezoelectric thin films without degrading the organic substrate.

In one example, the present design includes package-integrated structures to act as acoustic transducer devices. Those structures are manufactured as part of the package layers and are made free to vibrate or move by removing the dielectric material around them. The structures include piezoelectric stacks that are deposited and patterned layer-by-layer into the package. The present design includes creating acoustic transducer devices in the package on the principle of suspended and vibrating structures. Etching of the dielectric material in the package occurs to create cavities. Piezoelectric material deposition (e.g., 0.5 to 1 um deposition thickness) and crystallization also occur in the package substrate during the package fabrication process. An annealing operation at a substrate temperature range (e.g., up to 260° C.) that is lower than typically used for piezoelectric material annealing allows crystallization of the piezoelectric material (e.g., lead zirconate titanate (PZT), potassium sodium niobate (KNN), aluminum nitride (AlN), zinc oxide (ZnO), etc.) to occur during the package fabrication process without imparting thermal degradation or damage to the substrate layers. In one example, laser pulsed annealing occurs locally with respect to the piezoelectric material without damaging other layers of the package substrate (e.g., organic substrate) including organic layers.

Referring now to FIG. 1, a view of a microelectronic device 100 having package-integrated piezoelectric devices is shown, according to an embodiment. In one example, the microelectronic device 100 includes multiple devices 190 and 194 (e.g., die, chip, CPU, silicon die or chip, radio transceiver, etc.) that are coupled or attached to a package substrate 120 with solder balls 191-192, 195-196. The package substrate 120 is coupled or attached to the printed circuit board (PCB) 110 using, for example, solder balls 111 through 115.

The package substrate 120 (e.g., organic substrate) includes organic dielectric layers 128 and conductive layers 121-123 and 125-126. Organic materials may include any type of organic material such as flame retardant 4 (FR4), resin-filled polymers, prepreg (e.g., pre impregnated, fiber weave impregnated with a resin bonding agent), polymers, silica-filled polymers, etc. The package substrate 120 can be formed during package substrate processing (e.g., at panel level). The panels formed can be large (e.g., having in-plane (x, y) dimensions of approximately 0.5 meter by 0.5 meter, or greater than 0.5 meter, etc.) for lower cost. A cavity 142 is formed within the packaging substrate 120 by removing one or more layers (e.g., organic layers, dielectric layers, etc.) from the packaging substrate 120. The cavity 142 includes a lower member 143 and sidewalls 144-145. In one example, a piezoelectric transducer device 130 (e.g., acoustic transducer device) is formed with conductive structures 132 and 136 (e.g., cantilevers, beams, traces) and piezoelectric material 134. The three structures 132, 134, and 136 form a stack. The conductive structure 132 can act as a first electrode and the conductive movable base structure 136 can act as a second electrode of the piezoelectric vibrating device. The cavity 142 can be air filled or vacuum filled.

The base structure 136 (e.g., membrane 136) is free to vibrate in a vertical direction (e.g., along a z-axis). It is anchored on the cavity edges by package vias 126 and 127 which serve as both mechanical anchors as well as electrical connections to the rest of the package. In a transmit mode, a time varying (e.g., AC) voltage is applied between the electrodes of the piezoelectric stack which induces mechanical stress and deformation of the piezoelectric material 134. This causes the stack, and thus the released membrane 136 which is attached to it, to vibrate. Adjusting the voltage frequency to be at or close to the natural mechanical frequency of the system allows the system to operate at resonance and maximizes the amplitude of the generated acoustic wave 150 for a given input voltage.

In a receive mode, acoustic waves received by the membrane 136 cause the suspended structure to vibrate and the piezoelectric material 134 to deform. This induces a voltage across the piezoelectric stack which can be measured to determine the amplitude of the received acoustic waves.

Figure 2:
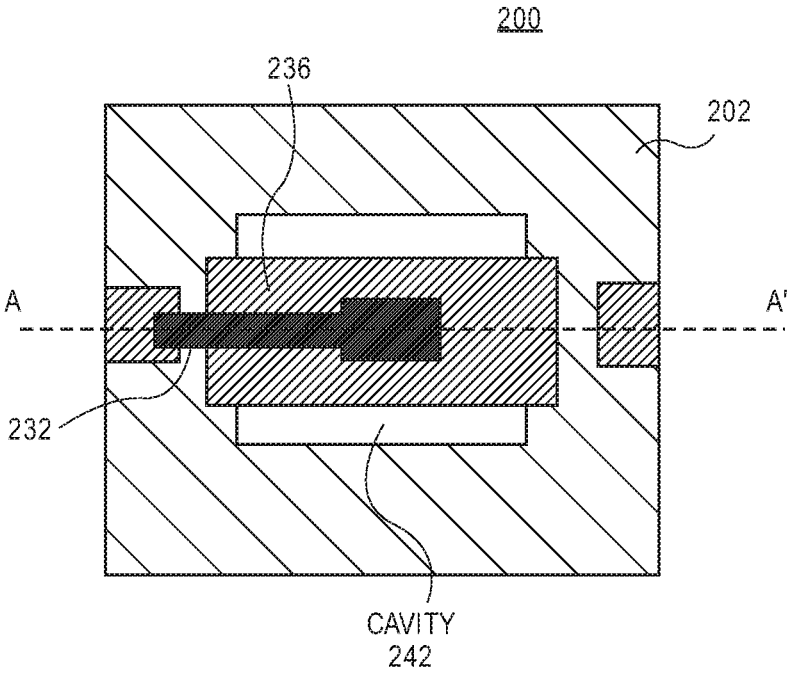
FIG. 2 illustrates a top view of a package substrate having a package-integrated piezoelectric transducer device, according to an embodiment.

FIG. 2 illustrates a top view of a package substrate having a package-integrated piezoelectric transducer device, according to an embodiment. In one example, the package substrate 200 may be coupled or attached to multiple devices (e.g., die, chip, CPU, silicon die or chip, RF transceiver, etc.) and may be also coupled or attached to a printed circuit board (e.g., PCB 110). The package substrate 200 (e.g., organic substrate) includes organic dielectric layers 202 and conductive layers 232 and 236. The package substrate 200 can be formed during package substrate processing (e.g., at panel level). A cavity 242 is formed within the packaging substrate 200 by removing one or more layers (e.g., organic layers, dielectric layers, etc.) from the packaging substrate 200. In one example, a piezoelectric transducer device is formed with conductive vibrating structures 232 and 236 and piezoelectric material sandwiched between them. The conductive structure 232 can act as a top electrode and the conductive movable base structure 236 can act as a bottom electrode of the piezoelectric device. In one example, the piezoelectric material (not shown) is disposed on the bottom electrode and the top electrode is disposed on the piezoelectric material. The cavity 242 can be air filled or vacuum filled. The conductive structure 236 is anchored on one edge by package connections (e.g., anchors, vias) which may serve as both mechanical anchors as well as electrical connections to the rest of the package.

Although FIG. 2 shows one specific membrane shape, another embodiment can have other membrane shapes (e.g., FIGS. 4-9B) in order to achieve different mechanical frequencies. The membrane can also have etching holes to help with the dielectric removal process in order to create the cavity. Also, different electrode shapes can be envisioned with contacts on one or more sides of the cavity.

Figure 3:
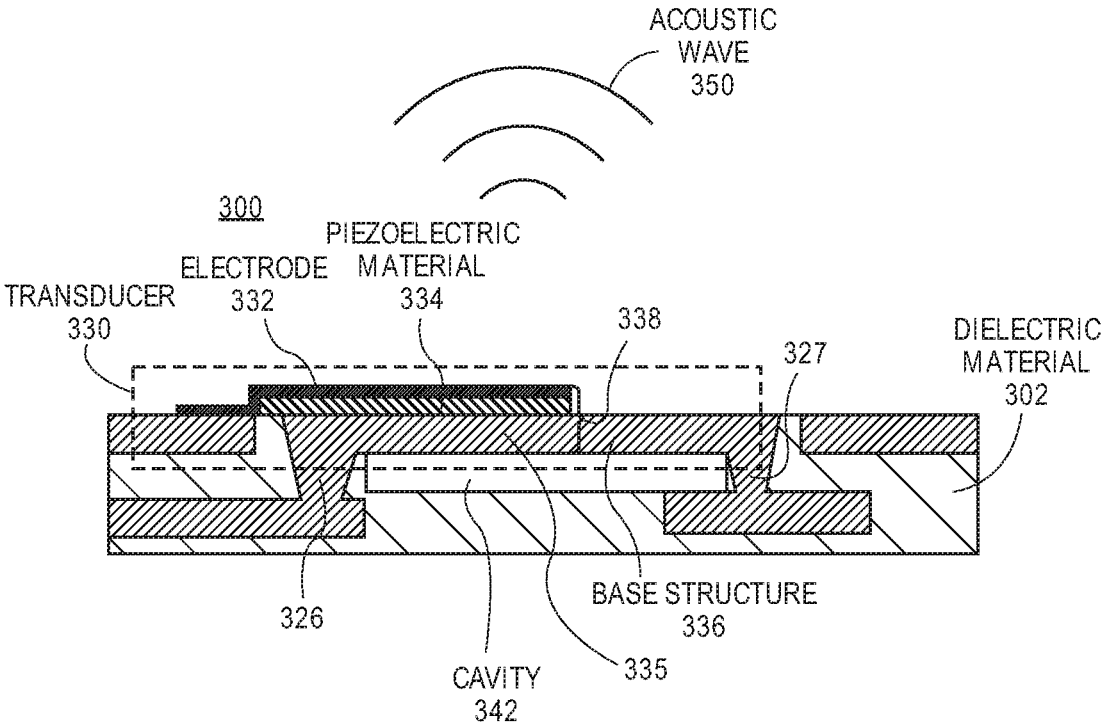
FIG. 3 illustrates a side view of a package substrate having a package-integrated piezoelectric device (e.g., transducer device), according to an embodiment.

FIG. 3 illustrates a side view of a package substrate having a package-integrated piezoelectric device (e.g., transducer device), according to an embodiment. The package substrate 300 (e.g., organic substrate) includes organic dielectric layers 302 (or layers 202) and conductive layers 326, 327, 332, and 336. The package substrate 300 can be formed during package substrate processing (e.g., at panel level). The package substrate 300 may represent a side view of the package substrate 200.

In one example, the package substrate 300 may be coupled or attached to multiple devices (e.g., die, chip, CPU, silicon die or chip, RF transceiver, etc.) and may also be coupled or attached to a printed circuit board (e.g., PCB 110). A cavity 342 is formed within the packaging substrate 300 by removing one or more layers (e.g., organic layers, dielectric layers, etc.) from the packaging substrate 300. In one example, a piezoelectric transducer device 330 includes a piezoelectric stack 338 that is formed with conductive vibrating structures 332 and 336 and piezoelectric material 334. The conductive structure 332 can act as a top electrode and the conductive movable base structure 336 can act as a bottom electrode of the piezoelectric device. A region 335 of the base structure 336 physically contacts the piezoelectric material 334. In one example, the piezoelectric material 334 is disposed on the bottom electrode and the top electrode is disposed on the material 334. The cavity 342 can be air filled or vacuum filled. The conductive structure 336 is anchored on one edge by package connections 326 (e.g., anchors, vias) which may serve as both mechanical anchors as well as electrical connections to the rest of the package. The conductive structure 336 is also anchored on one edge by package connections 327 (e.g., anchors, vias) which may serve as both mechanical anchors as well as electrical connections to the rest of the package.

This structure 336 is surrounded by a cavity and is free to move in a direction (e.g., a vertical direction). In another example, the structure is free to move in a different direction. The piezoelectric film 334 is mechanically attached to the base structure 336 and is sandwiched between the two conductive structures (electrodes). One of the electrodes can be the base structure itself.

In a transmit mode, a time varying (e.g., AC) voltage is applied between the electrodes of the piezoelectric stack 338 which induces mechanical stress and deformation of the piezoelectric material 334. This causes the stack, and thus the released structure 336 (e.g., membrane 336) which is attached to it, to vibrate. Adjusting the voltage frequency to be at or close to the natural mechanical frequency of the system allows the system to operate at resonance and maximizes the amplitude of the generated acoustic wave 350 for a given input voltage.

In a receive mode, acoustic waves received by the membrane 336 cause the suspended structure to vibrate and the piezoelectric material 334 to deform. This induces a voltage across the piezoelectric stack which can be measured to determine the amplitude of the received acoustic waves.

The stack 338 includes a piezoelectric material 334 (e.g., PZT, KNN, ZnO, etc.) or other materials sandwiched between conductive electrodes. The base structure 336 itself can be used as one of the electrodes as shown in FIG. 3, or alternatively, a separate conductive material can be used for one electrode after depositing an insulating layer to electrically isolate this first electrode from the conductive membrane as illustrated in FIG. 5.

Figure 4:
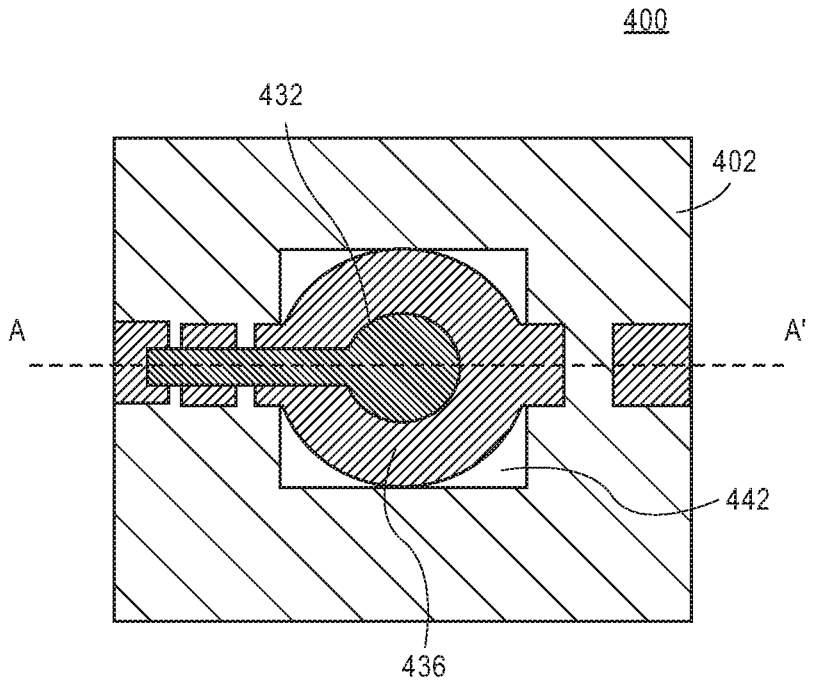
FIG. 4 illustrates a top view of a package substrate having a package-integrated piezoelectric device (e.g., transducer device), according to another embodiment.

FIG. 4 illustrates a top view of a package substrate having a package-integrated piezoelectric device (e.g., transducer device), according to another embodiment. The package substrate 400 (e.g., organic substrate), which includes organic dielectric layers 402 (or layers 402) and conductive layers 432 and 436, can be formed during package substrate processing (e.g., at panel level).

In one example, the package substrate 400 may be coupled or attached to multiple devices (e.g., die, chip, CPU, silicon die or chip, RF transceiver, etc.) and may be also coupled or attached to a printed circuit board (e.g., PCB 110). A cavity 442 is formed within the package substrate 400 by removing one or more organic dielectric layers 402 from the substrate 400. In one example, a piezoelectric transducer device is formed with conductive vibrating structures 432 and 436 and piezoelectric material 434 sandwiched between them. The conductive structure 432 can act as a top electrode and either a region of the conductive movable base structure 436 or a separate structure can act as a bottom electrode of the piezoelectric device. In one example, the piezoelectric material 434 is disposed on the bottom electrode and the top electrode is disposed on the material 434. The cavity 442 can be air filled or vacuum filled.

Figure 5:
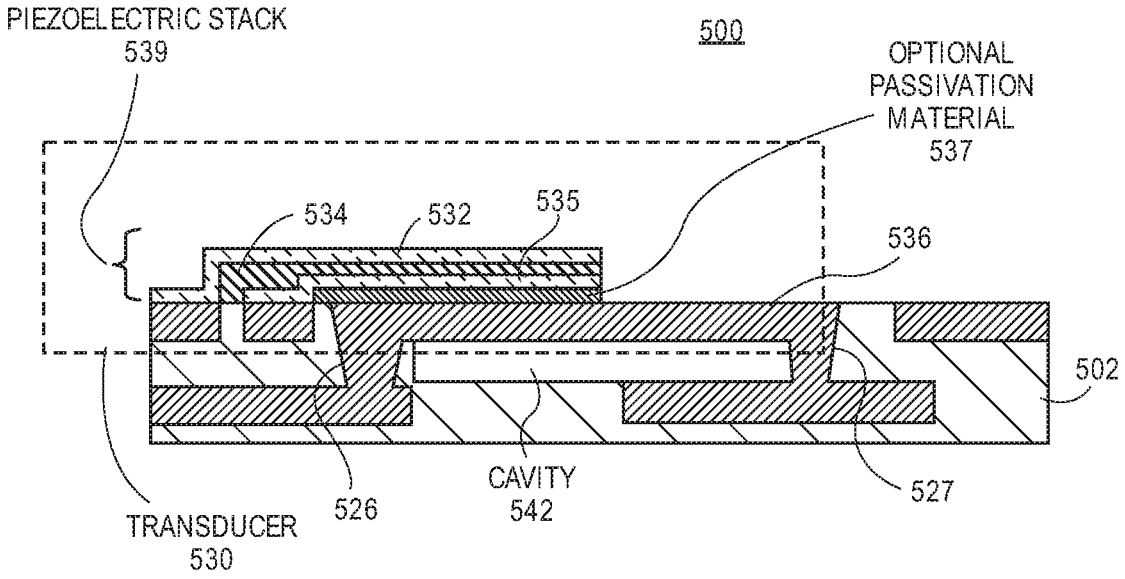
FIG. 5 illustrates a side view of a package substrate having a package-integrated piezoelectric device (e.g., transducer device), according to another embodiment.

FIG. 5 illustrates a side view of a package substrate having a package-integrated piezoelectric device (e.g., transducer device), according to an embodiment. The package substrate 500 (e.g., organic substrate) includes organic dielectric layers 502 (or layers 502) and conductive layers 526, 527, 532, 535, and 536. The package substrate 500 can be formed during package substrate processing (e.g., panel level). The package substrate 500 may represent a side view of the package substrate 400.

In one example, the package substrate 500 may be coupled or attached to multiple devices (e.g., die, chip, CPU, silicon die or chip, RF transceiver, etc.) and may also be coupled or attached to a printed circuit board (e.g., PCB 110). A cavity 542 is formed within the package substrate 500 by removing one or more layers (e.g., organic layers, dielectric layers, etc.) from the substrate 500. In one example, a piezoelectric transducer device 530 includes a piezoelectric stack 539 that is formed with conductive vibrating structures 532 and 535 and piezoelectric material 534 sandwiched between them. The conductive structure 532 can act as a top electrode and the conductive structure 535 can act as a bottom electrode of the piezoelectric device. In one example, the piezoelectric material 534 is disposed on the bottom electrode and the top electrode is disposed on the material 534. The cavity 542 can be air filled or vacuum filled. The conductive structure 536 is anchored on one edge by package connections 526 (e.g., anchors, vias) which may serve as both mechanical anchors as well as electrical connections to the rest of the package. The conductive structure 536 is also anchored on one edge by package connections 527 (e.g., anchors, vias) which may serve as both mechanical anchors as well as electrical connections to the rest of the package.

A separate conductive structure 535 can be used for one electrode after depositing an insulating layer 537 to electrically isolate this structure 535, which acts as a first electrode, from the conductive structure 536 (e.g., conductive membrane 536). The layer 537 electrically isolates the structure 535 and the structure 536. The different layers are deposited and patterned sequentially as part of the fabrication process of the piezoelectric stack.

Figure 6A:
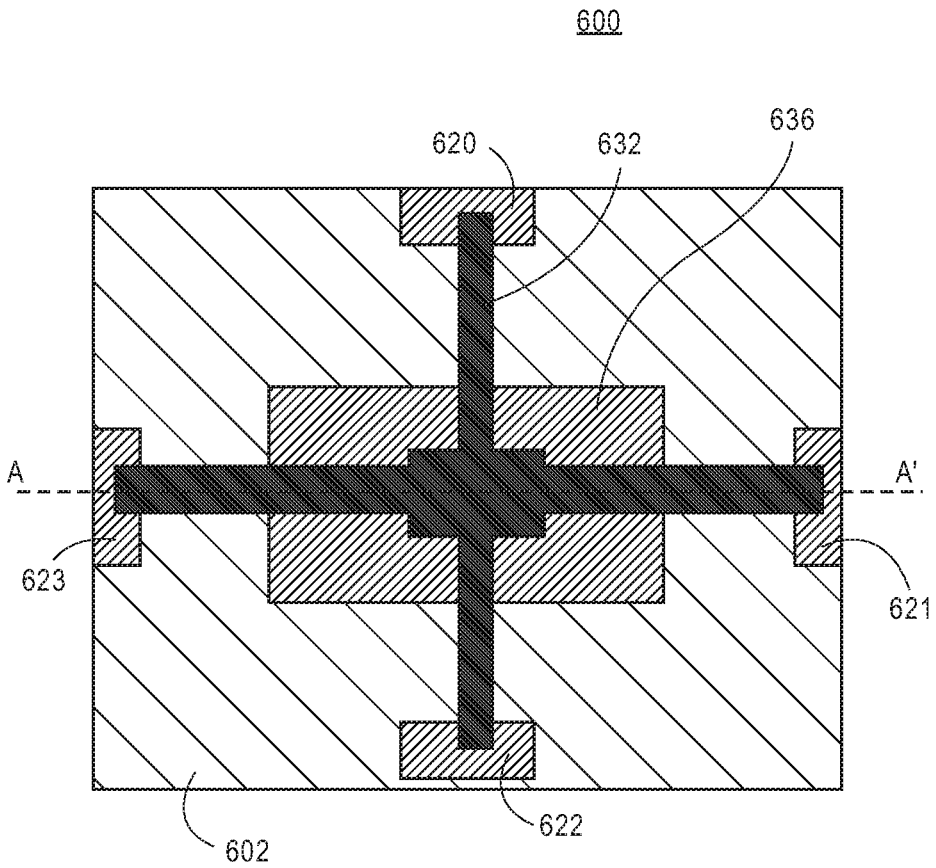
FIG. 6A illustrates a top view of a package substrate 600 (e.g., organic substrate)
Figure 6B:
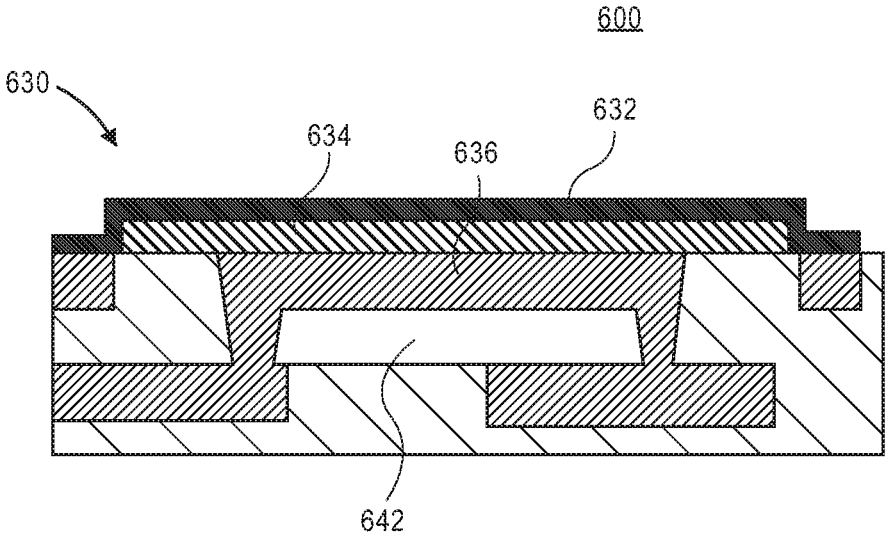
FIG. 6B illustrates a side view of the package substrate 600 in accordance with one embodiment.

FIG. 6A illustrates a top view of a package substrate 600 (e.g., organic substrate) and FIG. 6B illustrates a side view of the package substrate 600 in accordance with one embodiment. The package substrate 600 can be formed during package substrate processing (e.g., at panel level). In one example, the package substrate 600 may be coupled or attached to multiple devices (e.g., die, chip, CPU, silicon die or chip, RF transceiver, etc.) and may also be coupled or attached to a printed circuit board (e.g., PCB 110). The package substrate 600 (e.g., organic substrate) includes organic dielectric layers 602 and conductive layers 620-623, 632, and 636. A cavity 642 is formed within the package substrate 600 by removing one or more layers (e.g., organic layers, dielectric layers, etc.) from the packaging substrate 600.

In one example, a piezoelectric transducer device 630 is formed with conductive vibrating structures 632 and 636 and piezoelectric material 634 sandwiched between them as shown in FIG. 6B. The conductive structure 632 can act as top electrode and the conductive base structure 636 can act as a bottom electrode of the piezoelectric device. The cavity 642 can be air filled or vacuum filled. The conductive structure 632 is connected to electrical package connections 620-623.

Figure 7A:
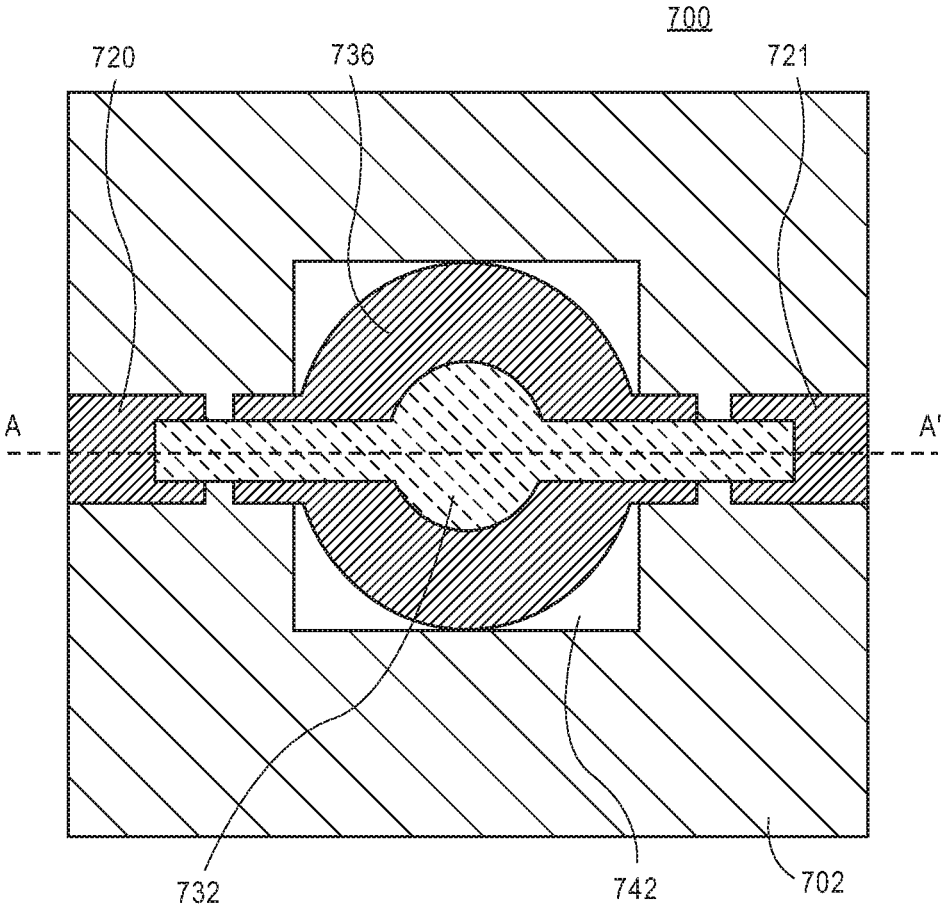
FIG. 7A illustrates a top view of a package substrate 700 (e.g., organic substrate)
Figure 7B:
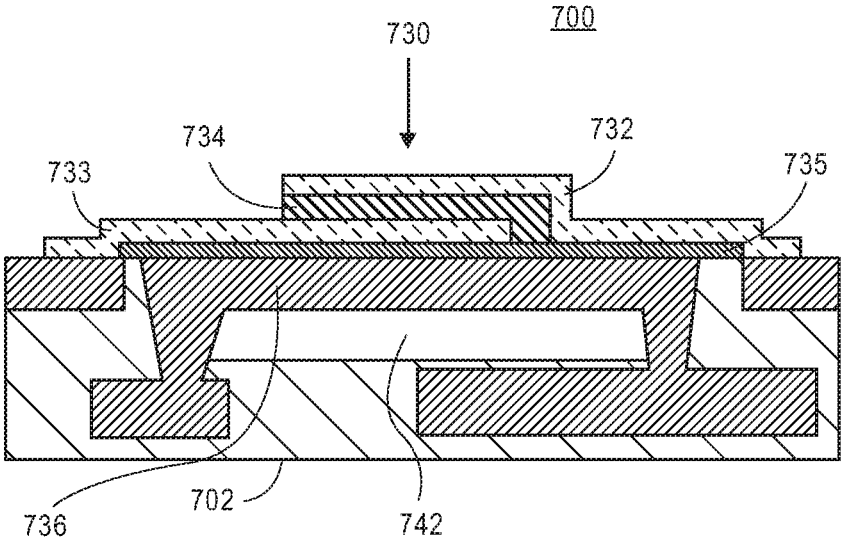
FIG. 7B illustrates a side view of the package substrate 700 in accordance with one embodiment.

FIG. 7A illustrates a top view of a package substrate 700 (e.g., organic substrate) and FIG. 7B illustrates a side view of the package substrate 700 in accordance with one embodiment. The package substrate 700 can be formed during package substrate processing (e.g., at panel level). In one example, the package substrate 700 may be coupled or attached to multiple devices (e.g., die, chip, CPU, silicon die or chip, RF transceiver, etc.) and may also be coupled or attached to a printed circuit board (e.g., PCB 110). The package substrate 700 (e.g., organic substrate) includes organic dielectric layers 702 and conductive layers 720, 721, 732, 733, and 736. A cavity 742 is formed within the package substrate 700 by removing one or more layers (e.g., organic layers, dielectric layers, etc.) from the substrate 700.

In one example, a piezoelectric transducer device 730 is formed with conductive vibrating structures 732 and 733 and piezoelectric material 734 sandwiched between them. The conductive structure 732 can act as top electrode and the conductive structure 733 can act as a bottom electrode of the piezoelectric device. The insulating layer 735 electrically isolates the conductive structure 733 from the conductive vibrating structure 736. The cavity 742 can be air filled or vacuum filled. The conductive structure 732 is connected to electrical package connections 720 and 721.

Figure 8A:
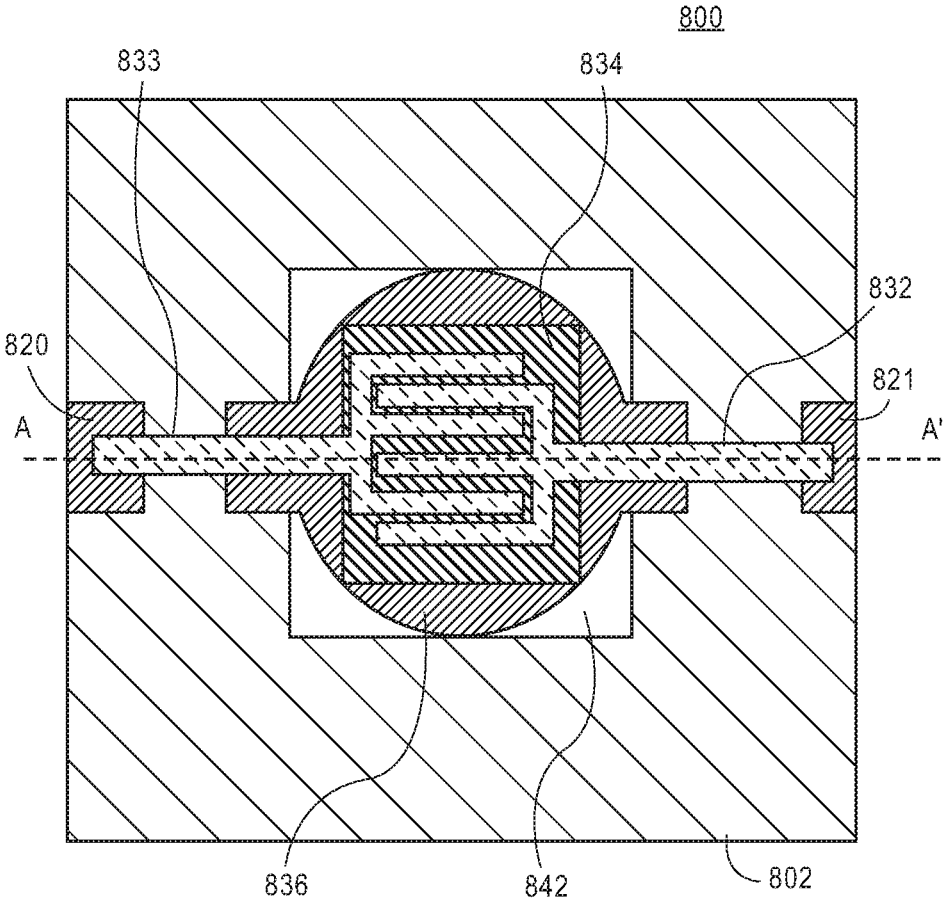
FIG. 8A illustrates a top view of a package substrate 800 (e.g., organic substrate)
Figure 8B:
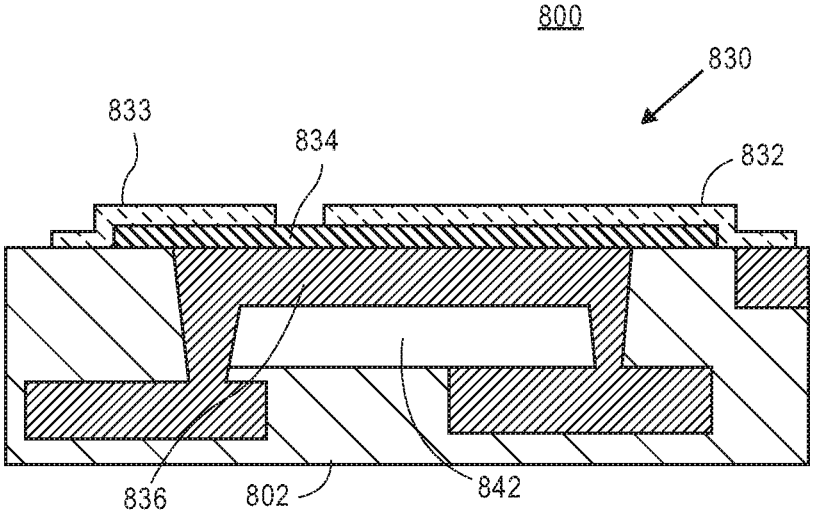
FIG. 8B illustrates a side view of the package substrate 800 in accordance with one embodiment.

FIG. 8A illustrates a top view of a package substrate 800 (e.g., organic substrate) and FIG. 8B illustrates a side view of the package substrate 800 in accordance with one embodiment. The package substrate 800 can be formed during package substrate processing (e.g., at panel level). In one example, the package substrate 800 may be coupled or attached to multiple devices (e.g., die, chip, CPU, silicon die or chip, RF transceiver, etc.) and may also be coupled or attached to a printed circuit board (e.g., PCB 110). The package substrate 800 (e.g., organic substrate) includes organic dielectric layers 802 and conductive layers 820, 821, 832, 833, and 836. A cavity 842 is formed within the packaging substrate 800 by removing one or more layers (e.g., organic layers, dielectric layers, etc.) from the packaging substrate 800.

In one example, a piezoelectric transducer device 830 is formed with conductive vibrating structures 832, 833, 836, and piezoelectric material 834. The conductive structures 832 and 833 can be interdigitated and act as electrodes of the piezoelectric device, whereas the conductive structure 836 can act as a structural layer of the transducer. In this example, the conductive structures 832 and 833 are patterned in the same horizontal plane in a layer above the piezoelectric material 834. In another example, the conductive structures 832 and 833 are created in the same layer below or underneath the piezoelectric material 834. The cavity 842 can be air filled or vacuum filled. The conductive structure 832 is connected to electrical package connections 821 and the conductive structure 833 is connected to electrical package connections 820.

In this configuration, applying a voltage between the electrodes 832 and 833 (which are patterned in the same horizontal plane) causes the piezoelectric stack and conductive structure 836 (membrane 836) to vibrate in a vertical direction along a z-axis perpendicular to the aforementioned horizontal plane.

Figure 9A:
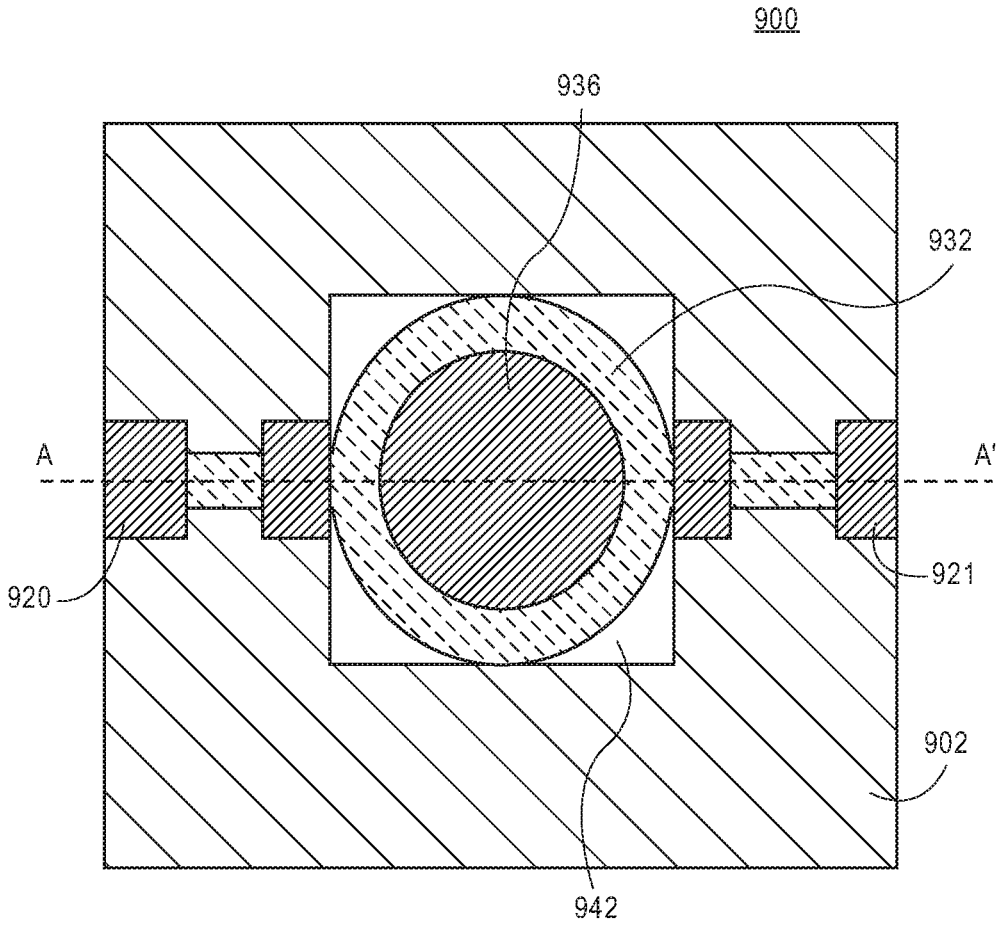
FIG. 9A illustrates a top view of a package substrate 900 (e.g., organic substrate)
Figure 9B:
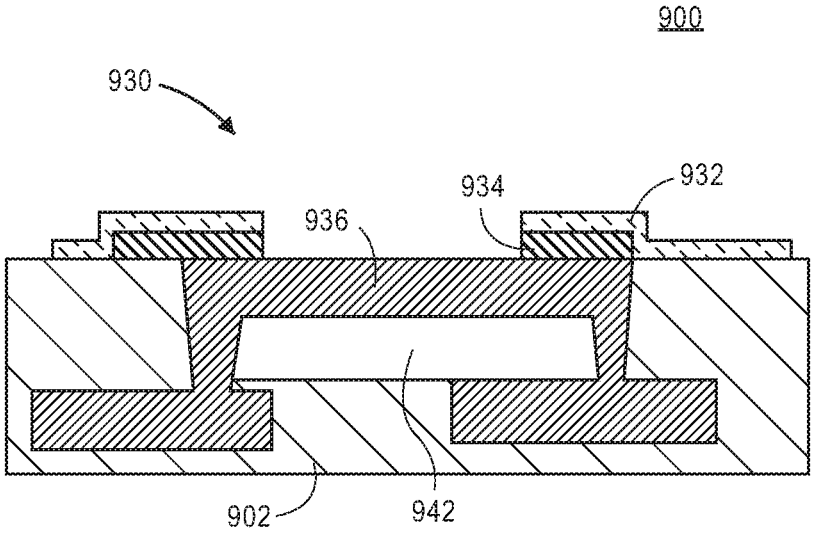
FIG. 9B illustrates a side view of the package substrate 900 in accordance with one embodiment.

FIG. 9A illustrates a top view of a package substrate 900 (e.g., organic substrate) and FIG. 9B illustrates a side view of the package substrate 900 in accordance with one embodiment. The package substrate 900 can be formed during package substrate processing (e.g., at panel level). In one example, the package substrate 900 may be coupled or attached to multiple devices (e.g., die, chip, CPU, silicon die or chip, RF transceiver, etc.) and may also be coupled or attached to a printed circuit board (e.g., PCB 110). The package substrate 900 (e.g., organic substrate) includes organic dielectric layers 902 and conductive layers 920, 921, 932, and 936. A cavity 942 is formed within the packaging substrate 900 by removing one or more layers (e.g., organic layers, dielectric layers, etc.) from the packaging substrate 900.

In one example, a piezoelectric transducer device 930 is formed with conductive vibrating structures 932, 936, and piezoelectric material 934 which is sandwiched between them. The conductive structure 932 having an annular ring shape acts as top electrode and the conductive structure 936 can act as a bottom electrode of the piezoelectric device. The cavity 942 can be air filled or vacuum filled. The conductive structure 932 is connected to electrical package connections 920 and 921.

The components (e.g., structures, electrodes, cavities) illustrated in various figures of the present design generally have rectangular or circular shapes though it is appreciated that these components can have any type of shape or configuration and may include electrical contacts on one or more sides of a cavity, electrodes on the same layer (e.g., interdigitated), or electrodes formed in different layers (e.g., sandwich structures).

Figure 10:
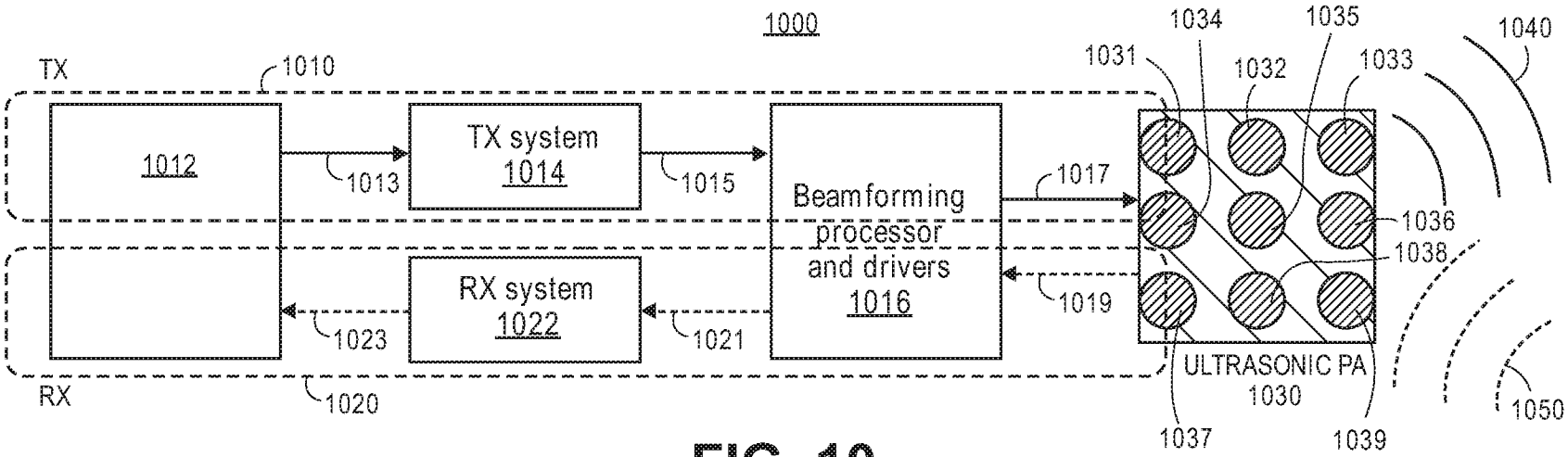
FIG. 10 illustrates a simplified block diagram of an ultrasonic phased array unit 1000 used in sonar applications in accordance with one embodiment.
Figure 11:
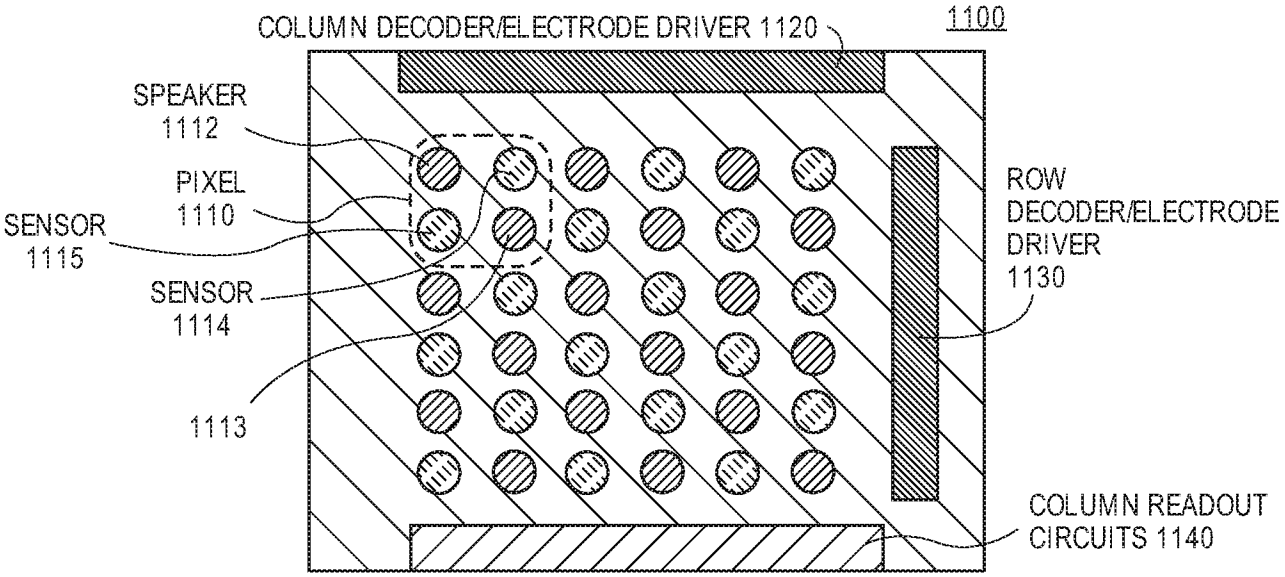
FIG. 11 illustrates a detailed view of an ultrasonic phased array unit 1100 used in sonar applications in accordance with one embodiment.

Standard sonars use discrete components (e.g., speakers & microphones), have high cost, require complex assembly, and result in large z-height (>>5 mm). In one example of ultra compact large area (e.g., 1-3 cm×1-3 cm) sonar, an array of ultrasonic transducers as illustrated in FIGS. 10-12 is fabricated using organic panel level technology. Every "pixel" of the array can include one "speaker" (e.g., ultrasound transmitter or generator) and one ultrasound microphone (e.g., receiver or sensor). Achieving tight integration results in a compact form factor (e.g., low z-height) and higher spatial resolution.

FIG. 10 illustrates a simplified block diagram of an acoustic (e.g., sonic, ultrasonic, infrasonic, etc.) phased array 1000 used in sonar applications in accordance with one embodiment. The unit 1000 includes a transmit functionality component 1010, a phase array 1030, and a receive functionality component 1020. The transmit functionality component 1010 includes a processing unit 1012 (e.g., at least one processor, a microcontroller, etc.), a transmit circuitry 1014, and beamforming and driving functionality 1016. The receive functionality component 1020 includes the processing unit 1012, a receive circuitry 1022, and the beamforming and driving functionality 1016. The processing unit 1012 processes instructions and generates output signals 1013 that are received by the transmit circuitry 1014 and used to generate electrical signals 1015. The beamforming and driving functionality 1016 generates a time delay for each electrical signal to be applied to a speaker or microphone 1031-1039 of the phased array 1030. The speakers (e.g., ultrasound transmitter, generator) convert the electrical signals 1017 into ultrasound waves 1040.

The sensors or microphones of the phased array 1030 may receive acoustic waves 1050 which are converted into electrical signals 1019. The functionality 1016 receives the electrical signals 1019 and generates output signals 1021. The receive circuitry 1022 generates receive signals 1023 based on the output signals 1021. The processing unit 1012 processes the receive signals 1023. In one example, the transmit functionality component 1010 and receive functionality component 1020 are formed in a silicon-based substrate and the phase array 1030 is formed in an organic substrate.

FIG. 11 illustrates a detailed view of an acoustic (e.g., sonic, ultrasonic, infrasonic, etc.) phased array unit 1100 used in acoustic applications in accordance with one embodiment. The unit 1100 includes pixels 1110 with each pixel including speakers (e.g., 1112, 1113) and sensors (e.g., 1114, 1115). The unit 1000 includes a column decoder/electrode driver 1120 and a row decoder/electrode driver 1130 for addressing pixels. A column readout circuitry 1140 (e.g., switching logic) provides an ability to read out data values from the pixels.

Figure 13:
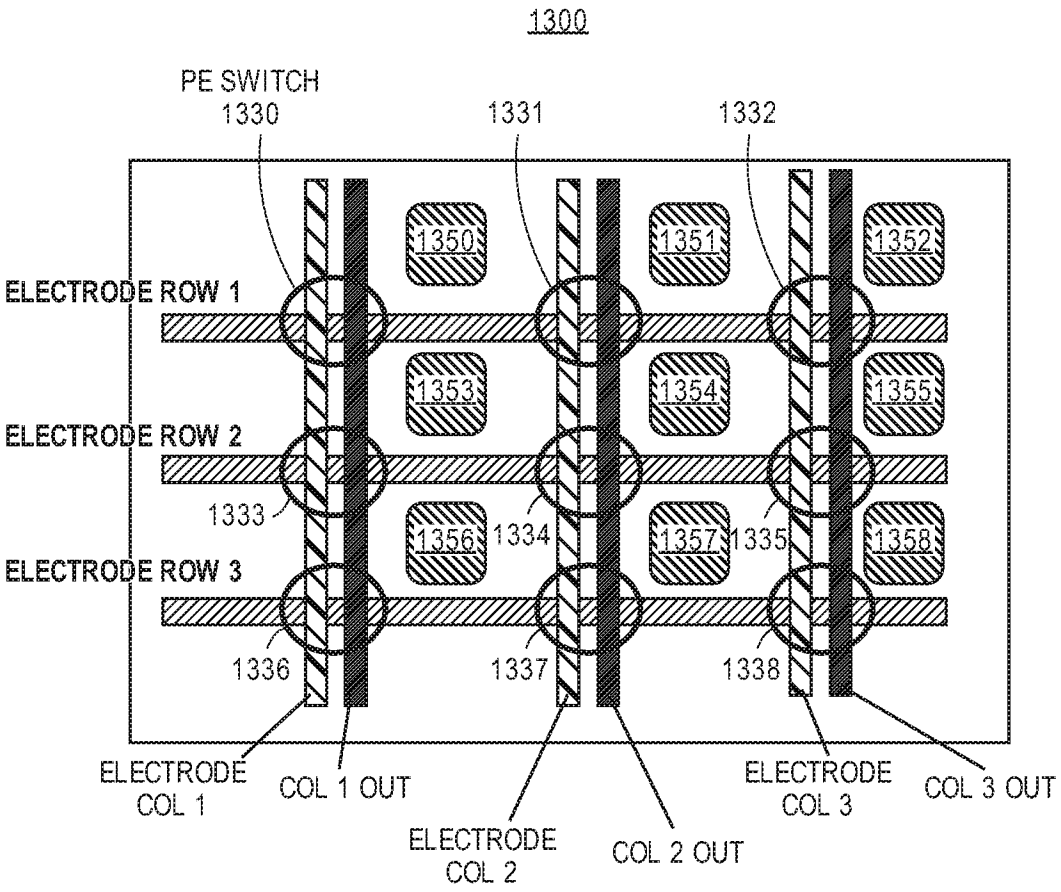
FIG. 13 illustrates XY (row, column) addressing using package-integrated piezoelectric switches in accordance with one embodiment.

In one example, the addressing of the row and column "pixels" can be performed with package-integrated switches. FIG. 13 illustrates XY (row, column) addressing using package-integrated piezoelectric switches in accordance with one embodiment. A package substrate 1300 includes an array of switches 1330-1338 for addressing an array of similar or different types of devices 1350-1358 (e.g., ultrasonic phased array, imaging array, antennas of RF imaging array, etc.). The switches can be any of the switches described in application Ser. No. 15/088,982, which is incorporated by reference herein, with each switch being fabricated at each intersection of rows 1-3 and columns 1-3 of the array of the package 1300. Choosing a row electrode and a column electrode allows actuating only the switch that has both electrodes driven, thus closing the path between a device 1350-1358 coupled to the actuated switch and a corresponding output column. For example, driving with a voltage the row electrode 1 and the column electrode 3, the switch 1332 will be actuated. It will then close/short the output of the device 1352 to the vertical column 3 output and hence this output can be read out with a custom designed circuit. The device outputs can be selectively routed to the vertical shared output columns, depending on which of the switches is actuated.

Figure 12A:
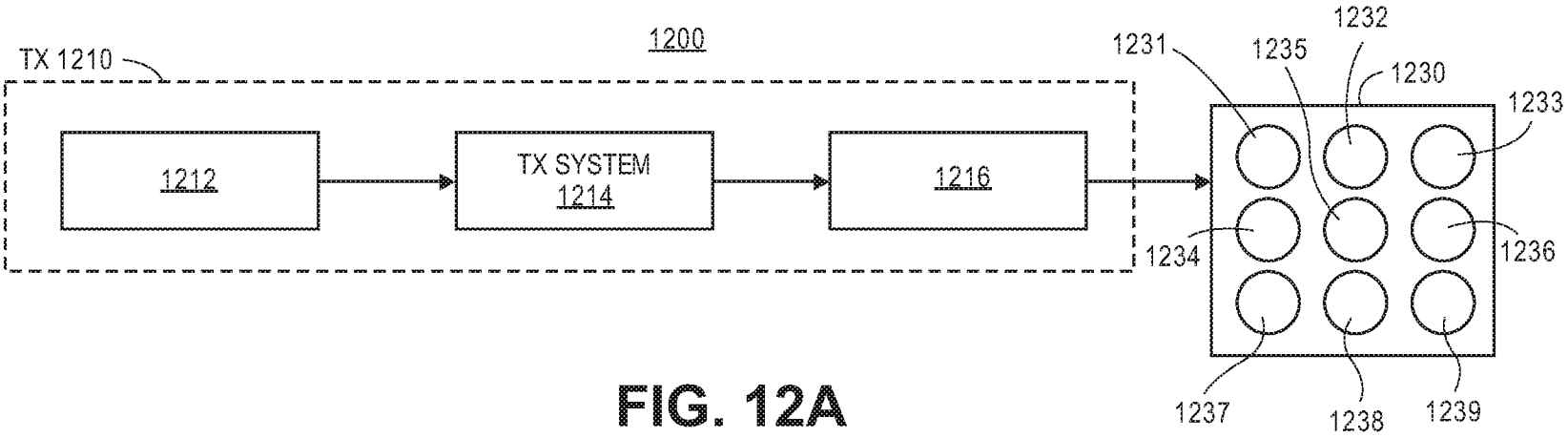
FIG. 12A illustrates a simplified block diagram of an ultrasonic phased array unit 1200 used in haptic feedback systems in accordance with one embodiment.

In another example, an array is designed for over the air (OTA) Texture transmission thru haptics. For the application of texture transmission over the air, an acoustic (e.g., sonic, ultrasonic, infrasonic, etc.) phased array unit is similar to the unit 1000 of FIG. 10 but without the receive functionality component 1020. FIG. 12A illustrates a simplified block diagram of an ultrasonic phased array unit 1200 used in haptics in accordance with one embodiment. The unit 1200 includes a transmit functionality component 1210 and a phased array 1230 having speakers (e.g., 1231-1239). The transmit functionality component 1210 includes a processing unit 1212 (e.g., at least one processor, a microcontroller, etc.), a transmit circuitry 1214, and beamforming and driving functionality 1216.

Figure 12B:
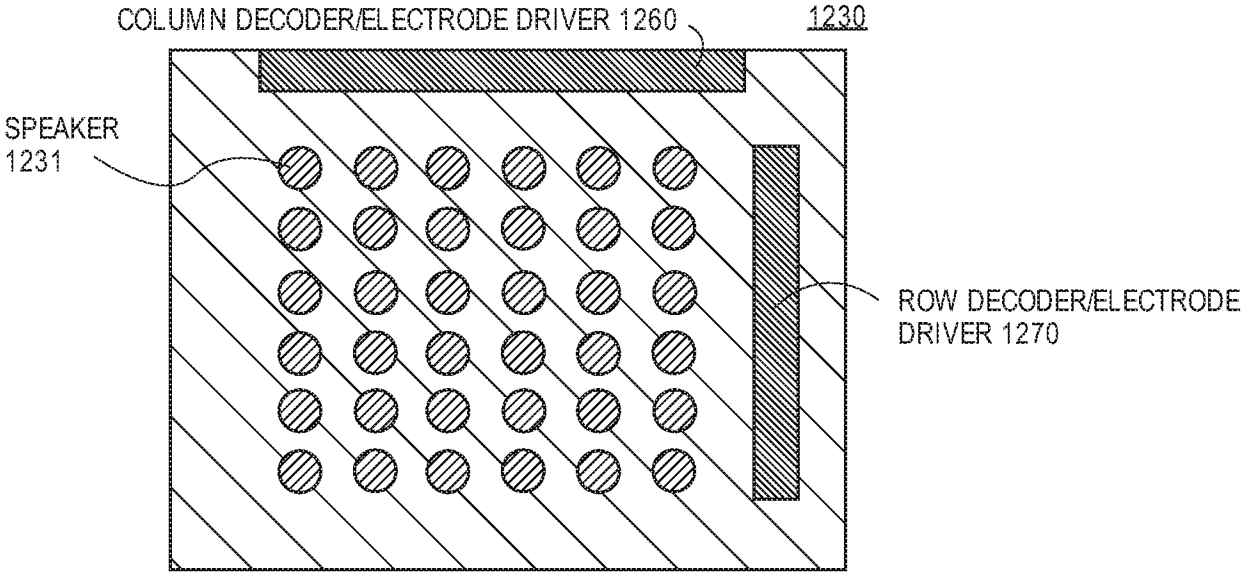
FIG. 12B illustrates a detailed view of an ultrasonic phase array 1230 used in haptic feedback systems in accordance with one embodiment.

FIG. 12B illustrates a detailed view of an acoustic (e.g., sonic, ultrasonic, infrasonic, etc.) phase array 1230 used in haptics in accordance with one embodiment. The array 1230 needs to contain only speakers (e.g., 1231) and not microphones/sensors since in this application no reflected signals are sensed. Therefore the pixels of FIGS. 12A and 12B contain only the speakers. Here the main difference in the transmit functionality of FIG. 12A compared to FIG. 10 is in how the beamforming processor 1216 is driven so as to create a focal plane over the phased array (e.g., at 100-300 mm above the phased array, at 200 mm above the phased array, etc.) where a user can feel focused ultrasound waves on their skin (e.g., fingertip area), thereby producing a haptic perception of texture. Standard OTA texture transferring systems employ focused ultrasound to project discrete points of haptic sensations on to users' hands. One advantage of the present design includes being able to produce larger area haptic ultrasonic focal planes, and also easier integration with a conventional electronic system (e.g., laptop/wearable), since the present design is compatible with panel level (e.g., 0.5 m×0.5 m sized panels) processing used for semiconductor packaging.

It will be appreciated that, in a system on a chip embodiment, the die may include a processor, memory, communications circuitry and the like. Though a single die is illustrated, there may be none, one or several dies included in the same region of the microelectronic device.

In one embodiment, the microelectronic device may be a crystalline substrate formed using a bulk silicon or a silicon-on-insulator substructure. In other implementations, the microelectronic device may be formed using alternate materials, which may or may not be combined with silicon, that include but are not limited to germanium, indium antimonide, lead telluride, indium arsenide, indium phosphide, gallium arsenide, indium gallium arsenide, gallium antimonide, or other combinations of group III-V or group IV materials. Although a few examples of materials from which the substrate may be formed are described here, any material that may serve as a foundation upon which a semiconductor device may be built falls within the scope of the present invention.

The microelectronic device may be one of a plurality of microelectronic devices formed on a larger substrate, such as, for example, a wafer. In an embodiment, the microelectronic device may be a wafer level chip scale package (WLCSP). In certain embodiments, the microelectronic device may be singulated from the wafer subsequent to packaging operations, such as, for example, the formation of one or more piezoelectric vibrating devices.

One or more contacts may be formed on a surface of the microelectronic device. The contacts may include one or more conductive layers. By way of example, the contacts may include barrier layers, organic surface protection (OSP) layers, metallic layers, or any combination thereof. The contacts may provide electrical connections to active device circuitry (not shown) within the die. Embodiments of the invention include one or more solder bumps or solder joints that are each electrically coupled to a contact. The solder bumps or solder joints may be electrically coupled to the contacts by one or more redistribution layers and conductive vias.

Figure 14:
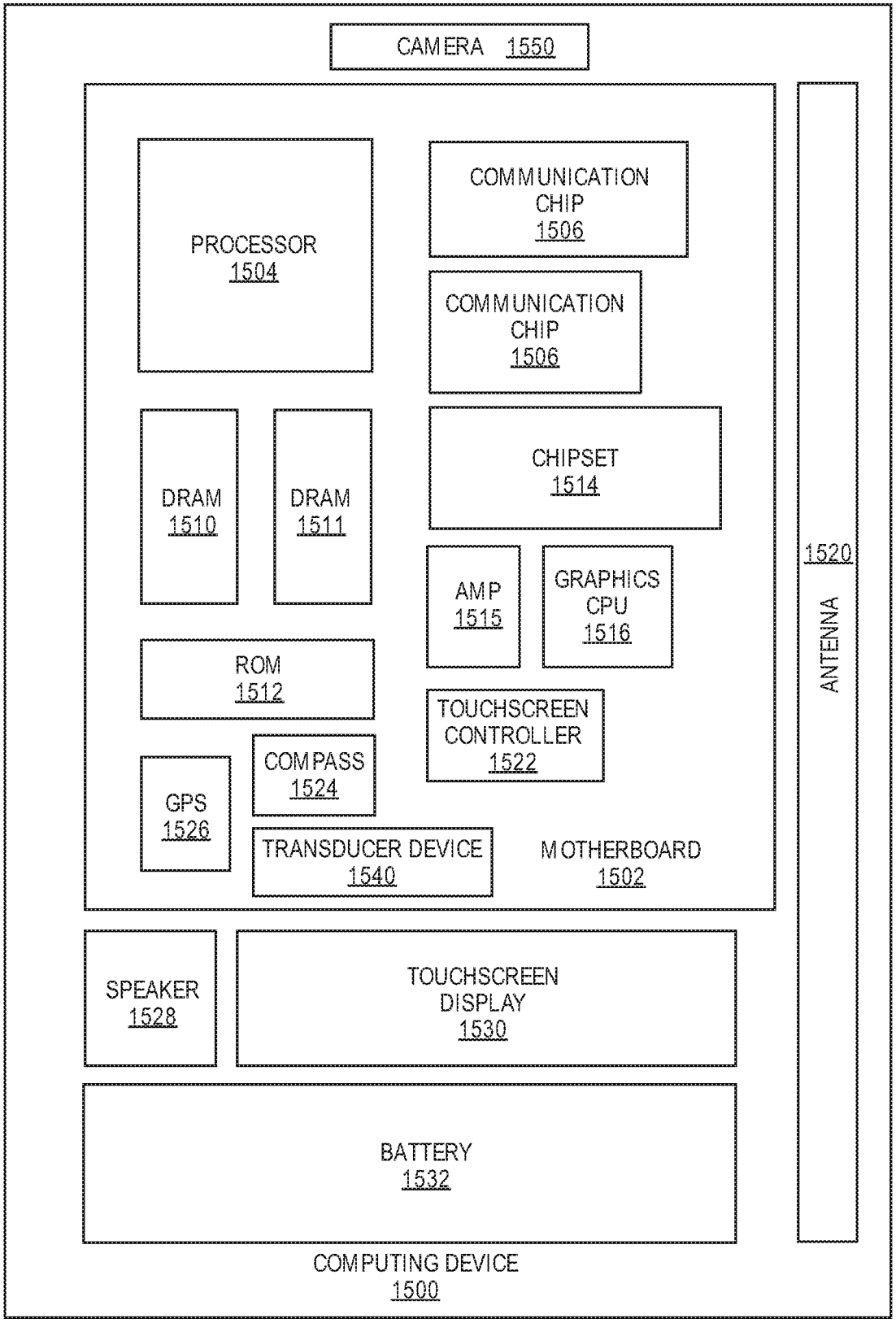
FIG. 14 illustrates a computing device 1500 in accordance with one embodiment of the invention.

FIG. 14 illustrates a computing device 1500 in accordance with one embodiment of the invention. The computing device 1500 houses a board 1502. The board 1502 may include a number of components, including but not limited to a processor 1504 and at least one communication chip 1506. The processor 1504 is physically and electrically coupled to the board 1502. In some implementations the at least one communication chip 1506 is also physically and electrically coupled to the board 1502. In further implementations, the communication chip 1506 is part of the processor 1504.

Depending on its applications, computing device 1500 may include other components that may or may not be physically and electrically coupled to the board 1502. These other components include, but are not limited to, volatile memory (e.g., DRAM 1510, 1511), non-volatile memory (e.g., ROM 1512), flash memory, a graphics processor 1516, a digital signal processor, a crypto processor, a chipset 1514, an antenna 1520, a display, a touchscreen display 1530, a touchscreen controller 1522, a battery 1532, an audio codec, a video codec, a power amplifier 1515, a global positioning system (GPS) device 1526, a compass 1524, a transducer device 1540 (e.g., a piezoelectric transducer device), a gyroscope, a speaker, a camera 1550, and a mass storage device (such as hard disk drive, compact disk (CD), digital versatile disk (DVD), and so forth).

The communication chip 1506 enables wireless communications for the transfer of data to and from the computing device 1500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 1506 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing device 1500 may include a plurality of communication chips 1506. For instance, a first communication chip 1506 may be dedicated to shorter range wireless communications such as Wi-Fi, WiGig and Bluetooth and a second communication chip 1506 may be dedicated to longer range wireless communications such as GPS, EDGE, GPRS, CDMA, WiMAX, LTE, Ev-DO, 5G, and others.

The processor 1504 of the computing device 1500 includes an integrated circuit die packaged within the processor 1504. In some implementations of the invention, the integrated circuit processor package or motherboard 1502 includes one or more devices, such as transducer devices in accordance with implementations of embodiments of the invention. The term "processor" may refer to any device or portion of a device that processes electronic data from registers and/or memory to transform that electronic data into other electronic data that may be stored in registers and/or memory. The communication chip 1506 also includes an integrated circuit die packaged within the communication chip 1506. The following examples pertain to further embodiments. Example 1 is a transducer device comprising a base structure that is positioned in proximity to a cavity of an organic substrate, a piezoelectric material in contact with a first electrode of the base structure, and a second electrode in contact with the piezoelectric material. For a transmit mode, a voltage signal is applied between the first and second electrodes and this causes a stress in the piezoelectric material which causes a stack that is formed with the first electrode, the piezoelectric material, and the second electrode to vibrate and hence the base structure to vibrate and generate acoustic waves.

In example 2, the subject matter of example 1 can optionally include the transducer device being integrated with the organic substrate which is fabricated using panel level processing.

In example 3, the subject matter of any of examples 1-2 can optionally include the base structure being positioned above the cavity of the organic substrate to allow vibrations of the base structure.

In example 4, the subject matter of any of examples 1-3 can optionally include, for a receive mode, acoustic waves received by the transducer device causing the base structure to vibrate which causes a stress in the piezoelectric material and this induces a potential difference (e.g., electric potential difference) across the piezoelectric material.

In example 5, the subject matter of any of examples 1-4 can optionally include the potential difference being measured by the first and second electrodes to determine amplitude of the received acoustic waves.

In example 6, the subject matter of any of examples 1-5 can optionally include the base structure including a plurality of holes to increase an etch rate of organic material of the organic substrate for forming the cavity.

In example 7, the subject matter of any of examples 1-6 can optionally include the first electrode being coupled to a first electrical connection of the organic substrate in proximity to a first end of the cavity of the organic substrate and the second electrode being coupled to a second electrical connection of the organic substrate in proximity to the first end of the cavity.

In example 8, the subject matter of any of examples 1-7 can optionally include the first electrode being coupled to a third electrical connection of the organic substrate in proximity to a second end of the cavity of the organic substrate and the second electrode being coupled to a fourth electrical connection of the organic substrate in proximity to the second end of the cavity.

Example 9 is a package substrate comprising a plurality of organic dielectric layers and a plurality of conductive layers to form the package substrate, a cavity formed in the package substrate, and a piezoelectric transducer device integrated within the package substrate. The piezoelectric transducer device includes a base structure that is positioned in proximity to the cavity and a film stack that includes a piezoelectric material in contact with a first electrode and a second electrode. For a transmit mode, a voltage signal is applied between the first and second electrodes and this causes a stress in the piezoelectric material which causes the film stack and hence the base structure to vibrate and generate acoustic waves.

In example 10, the subject matter of example 9 can optionally include an insulating layer positioned between a region of the base structure and the first electrode.

In example 11, the subject matter of any of examples 9-10 can optionally include the piezoelectric device being integrated with the organic substrate which is fabricated using panel level processing.

In example 12, the subject matter of any of examples 9-11 can optionally include the base structure being positioned above a cavity of the organic substrate to allow vibrations of the base structure.

In example 13, the subject matter of any of examples 9-12 can optionally include, for a receive mode, acoustic waves received by the transducer device causing the base structure to vibrate which causes a stress in the piezoelectric material and this induces a potential difference (e.g., electric potential difference) across the piezoelectric material.

In example 14, the subject matter of any of examples 9-13 can optionally include the potential difference being measured by the first and second electrodes to determine amplitude of the received acoustic waves.

In example 15, the subject matter of any of examples 9-14 can optionally include the base structure having a plurality of holes to increase an etch rate of the organic dielectric layers of the organic substrate for forming the cavity.

Example 16 is a system formed in a package substrate comprising a transmit functionality component having a processing unit, a transmit circuitry, and beamforming circuitry. The transmitting functionality is for transmitting electrical signals. An acoustic phased array is coupled to the transmit functionality component. The acoustic phased array comprises a first plurality of piezoelectric transducers which receive the electric signals and convert the electrical signals into acoustic waves to be transmitted. The first plurality of piezoelectric transducers are formed within the package substrate having organic material.

In example 17, the subject matter of example 16 can optionally include a receive functionality component coupled to the acoustic phased array. The acoustic phased array further comprises a second plurality of piezoelectric transducers to receive acoustic waves and convert the acoustic waves into electrical signals to be sent to the receive functionality component.

In example 18, the subject matter of any of examples 16-17 can optionally include the first plurality of piezoelectric transducers transmitting the acoustic waves into a focal plane to generate a haptic perception of texture.

Example 19 is a computing device comprising at least one processor to process data and a package substrate coupled to the at least one processor. The package substrate includes a plurality of organic dielectric layers and a plurality of conductive layers to form the package substrate which includes a piezoelectric transducer device having a base structure that is positioned in proximity to a cavity of the package substrate, a piezoelectric material in contact with a first electrode of the base structure and a second electrode in contact with the piezoelectric material. For a transmit mode, a voltage signal is applied between the first and second electrodes and this causes a stress in the piezoelectric material which causes a stack that is formed with the first electrode, piezoelectric material, and the second electrode to vibrate and hence the base structure to vibrate and generate acoustic waves.

In example 20, the subject matter of example 19 can optionally include the transducer device being integrated with the organic substrate which is fabricated using panel level processing.

In example 21, the subject matter of any of examples 19-20 can optionally include, for a receive mode, acoustic waves received by the transducer device causing the base structure to vibrate which causes a stress in the piezoelectric material and this induces a potential difference across the piezoelectric material.

In example 22, the subject matter of example 19 can optionally include a printed circuit board coupled to the package substrate.

The invention claimed is:

1. A transducer device, comprising:

a base structure that is positioned in proximity to a cavity of an organic substrate the cavity comprising a lower member and sidewalls of the organic substrate;

a piezoelectric material in contact with a first electrode of the base structure, and a second electrode in contact with the piezoelectric material, wherein for a transmit mode a voltage signal is applied between the first and second electrodes and this causes a stress in the piezoelectric material which causes a stack that is formed with the first electrode, the piezoelectric material, and the second electrode to vibrate and hence the base structure to vibrate and generate acoustic waves.

2. The transducer device of claim 1, wherein the transducer device is integrated with the organic substrate which is fabricated using panel level processing.

3. The transducer device of claim 2, wherein the base structure is positioned above the cavity of the organic substrate to allow vibrations of the base structure.

4. The transducer device of claim 1, wherein for a receive mode acoustic waves received by the transducer device cause the base structure to vibrate which causes a stress in the piezoelectric material and this induces a potential difference across the piezoelectric material.

5. The transducer device of claim 4, wherein the potential difference is measured by the first and second electrodes to determine amplitude of the received acoustic waves.

6. The transducer device of claim 1, wherein the base structure includes a plurality of holes to increase an etch rate of organic material of the organic substrate for forming the cavity.

7. The transducer device of claim 6, wherein the first electrode is coupled to a first electrical connection of the organic substrate in proximity to a first end of the cavity of the organic substrate and the second electrode is coupled to a second electrical connection of the organic substrate in proximity to the first end of the cavity.

8. The transducer device of claim 7, wherein the first electrode is coupled to a third electrical connection of the organic substrate in proximity to a second end of the cavity of the organic substrate and the second electrode is coupled to a fourth electrical connection of the organic substrate in proximity to the second end of the cavity.

9. A package substrate comprising:

a plurality of organic dielectric layers and a plurality of conductive layers to form the package substrate;

a cavity formed in the package substrate, the cavity comprising a lower member and sidewalls of the package substrate; and a piezoelectric transducer device integrated within the package substrate, the piezoelectric transducer device including a base structure that is positioned in proximity to the cavity and a stack that includes a piezoelectric material in contact with a first electrode and a second electrode, wherein for a transmit mode a voltage signal is applied between the first and second electrodes and this causes a stress in the piezoelectric material which causes the stack and hence the base structure to vibrate and generate acoustic waves.

10. The package substrate of claim 9, further comprising:

an insulating layer positioned between a region of the base structure and the first electrode.

11. The package substrate of claim 9, wherein the piezoelectric device is integrated with the organic substrate which is fabricated using panel level processing.

12. The package substrate of claim 9, wherein the base structure is positioned above a cavity of the organic substrate to allow vibrations of the base structure.

13. The package substrate of claim 9, wherein for a receive mode acoustic waves received by the transducer device cause the base structure to vibrate which causes a stress in the piezoelectric material and this induces a potential difference across the piezoelectric material.

14. The package substrate of claim 13, wherein the potential difference is measured by the first and second electrodes to determine amplitude of the received acoustic waves.

15. The package substrate of claim 9, wherein the base structure includes a plurality of holes to increase an etch rate of the organic dielectric layers of the organic substrate for forming the cavity.

16. A system formed in a package substrate, comprising:

a transmit functionality component having a processing unit, a transmit circuitry, and beamforming circuitry, the transmitting functionality for transmitting electrical signals; and an acoustic phased array coupled to the transmit functionality component, the acoustic phased array comprises a first plurality of piezoelectric transducers which receive the electric signals and convert the electrical signals into acoustic waves to be transmitted, wherein the first plurality of piezoelectric transducers are formed within the package substrate having organic material, the first plurality of piezoelectric transducers proximate a cavity formed in the package substrate having organic material, the cavity comprising a lower member and sidewalls of the package substrate having organic material.

17. The system of claim 16, further comprising:

a receive functionality component coupled to the acoustic phased array, wherein the acoustic phased array further comprises a second plurality of piezoelectric transducers to receive acoustic waves and convert the acoustic waves into electrical signals to be sent to the receive functionality component.

18. The system of claim 16, wherein the first plurality of piezoelectric transducers transmit the acoustic waves into a focal plane to generate a haptic perception of texture.

19. A computing device comprising:

at least one processor to process data; and a package substrate coupled to the at least one processor, the package substrate includes a plurality of organic dielectric layers and a plurality of conductive layers to form the package substrate which includes a piezoelectric transducer device having a base structure that is positioned in proximity to a cavity of the package substrate, a piezoelectric material in contact with a first electrode of the base structure and a second electrode in contact with the piezoelectric material, the cavity comprising a lower member and sidewalls of the package substrate, wherein for a transmit mode a voltage signal is applied between the first and second electrodes and this causes a stress in the piezoelectric material which causes a stack that is formed with the first electrode, piezoelectric material, and the second electrode to vibrate and hence the base structure to vibrate and generate acoustic waves.

20. The computing device of claim 19, wherein the transducer device is integrated with the organic substrate which is fabricated using panel level processing.

21. The computing device of claim 19, wherein for a receive mode acoustic waves received by the transducer device cause the base structure to vibrate which causes a stress in the piezoelectric material and this induces a potential difference across the piezoelectric material.

22. The computing device of claim 19, further comprising:

a printed circuit board coupled to the package substrate.

* * * * *